United States Patent [19]

Roark et al.

[11] 4,325,534

[45] Apr. 20, 1982

[54] MANUALLY OPERATED BLOWOUT PREVENTER AND HYDRAULIC OPERATOR THEREFOR

[75] Inventors: James T. Roark; Steven R. Hayter, both of Dallas, Tex.

[73] Assignee: Otis Engineering Corporation, Dallas, Tex.

[21] Appl. No.: 195,995

[22] Filed: Oct. 10, 1980

Related U.S. Application Data

[63] Continuation of Ser. No. 962,806, Nov. 21, 1978, abandoned.

[51] Int. Cl.[3] ..... E21B 33/06

[52] U.S. Cl. ..... 251/1 A; 251/14; 251/59; 251/291; 74/424.8 VA; 277/127

[58] Field of Search ..... 251/1 R, 1 A, 14, 59, 251/120, 133–136, 291; 137/269; 277/126, 127, 129; 74/424.8 VA, 625, 626

[56] References Cited

U.S. PATENT DOCUMENTS

| | | | |
|---|---|---|---|
| 1,786,363 | 12/1930 | Pate | 251/133 |
| 2,593,793 | 4/1952 | Rector | 277/129 |
| 2,598,062 | 5/1952 | Krecan | 251/134 |
| 3,174,355 | 3/1965 | De Craene | 74/424.8 VA |
| 3,220,282 | 11/1965 | Magos | 74/424.8 VA |
| 3,330,289 | 7/1967 | Grace | 251/59 |
| 4,062,306 | 12/1977 | Wosmek | 251/59 |

FOREIGN PATENT DOCUMENTS

| | | | |
|---|---|---|---|
| 1142557 | 2/1969 | United Kingdom | 251/130 |

*Primary Examiner*—H. Jay Spiegel
*Attorney, Agent, or Firm*—Vinson & Elkins

[57] ABSTRACT

A blowout preventer having a body with a bore and opposing guideways intersecting the bore, a ram in each of the guideways, a cap closing the outer end of each of the guideways, an operating stem connecting to each of said rams, extending through its cap in threaded engagement and having means for engagement by a handle, such as flats on its outer end, a pair of hydraulic motors each having a housing and a rotating shaft, means for securing said motor housings to the body surrounding said guideways, means for connecting said drive shafts with the operating stems to rotate said stems, and means supplying hydraulic fluid to said motors for selective rotation of said shafts and said stems in preselected directions.

5 Claims, 7 Drawing Figures

MANUALLY OPERATED BLOWOUT PREVENTER AND HYDRAULIC OPERATOR THEREFOR

CROSS REFERENCE TO RELATED APPLICATION

This application is a continuation application of our prior copending application Ser. No. 05/962,806, filed Nov. 21, 1978, now abandoned.

BACKGROUND

Some blowout preventers of the prior art have been manually operated by handwheels and then when it is desired to convert them from manual operation to power operation, a substantially complete disassembly of the structure has been required. In such structure the threaded operation stem and cap are replaced by a piston and cylinder arrangement. A typical example of such structure is shown on page 802 of the Bowen Tools, Inc., 1976-1977 General Catalog as published by World Oil in Vol. 1. of the 1976-77 Composite Catalog of Oil Field Equipment and Services.

Also in the prior art, many blowout preventers have been hydraulically operated and have included a manual override such as shown in U.S. Pat. No. 3,692,316.

The conversion of the manual blowout preventers of the prior art has had the disadvantages of being complicated and not being able to perform the conversion while the blowout preventer is under pressure. The hydraulically operated blowout preventer with a manual override is not applicable to relatively quick in place conversion from manual operated without power to a power operated blowout preventer since it is not solely a manual operated structure.

SUMMARY

The present invention relates to an improved apparatus for quickly and simply converting a manually operated blowout preventer to a power operated preventer which conversion may be accomplished while the blowout preventer is installed and exposed to well pressure.

The present invention includes a manually operated blowout preventer having a body with a bore and a pair of opposed guideways intersecting the bore, rams in each of the guideways, means closing the outer ends of the guideways, a stem connected to each ram and threading through the closing means so that rotation of the stems move the rams in the guideways and an adapter for each ram including a motor having a housing and a drive shaft, means for connecting the housing to the body around the outer end of the guideway and means for connecting the drive shaft to the stem so that rotation of the drive shafts rotate the stems to operate the rams.

An object of the present invention is to provide an improved blowout preventer apparatus having a threaded stem for manual operation which is simply and quickly converted for power operation.

Another object is to provide an improved adapter apparatus for installing on a blowout preventer to convert it from manual operation to power operation which installation may be accomplished without isolating or removing the blowout preventer from the wellhead.

A further object is to provide an improved apparatus for converting a manually operated blowout preventer to power operation which can be quickly installed on the blowout preventer.

Still another object is to provide an improved apparatus for converting a manually operated blowout preventer to power operation without changing the positions of the rams.

BRIEF DESCRIPTION OF THE DRAWINGS

These and other objects and advantages of the present invention are hereinafter set forth with reference to the drawings wherein.

DESCRIPTION OF THE PREFERRED EMBODIMENTS

Figure 1:
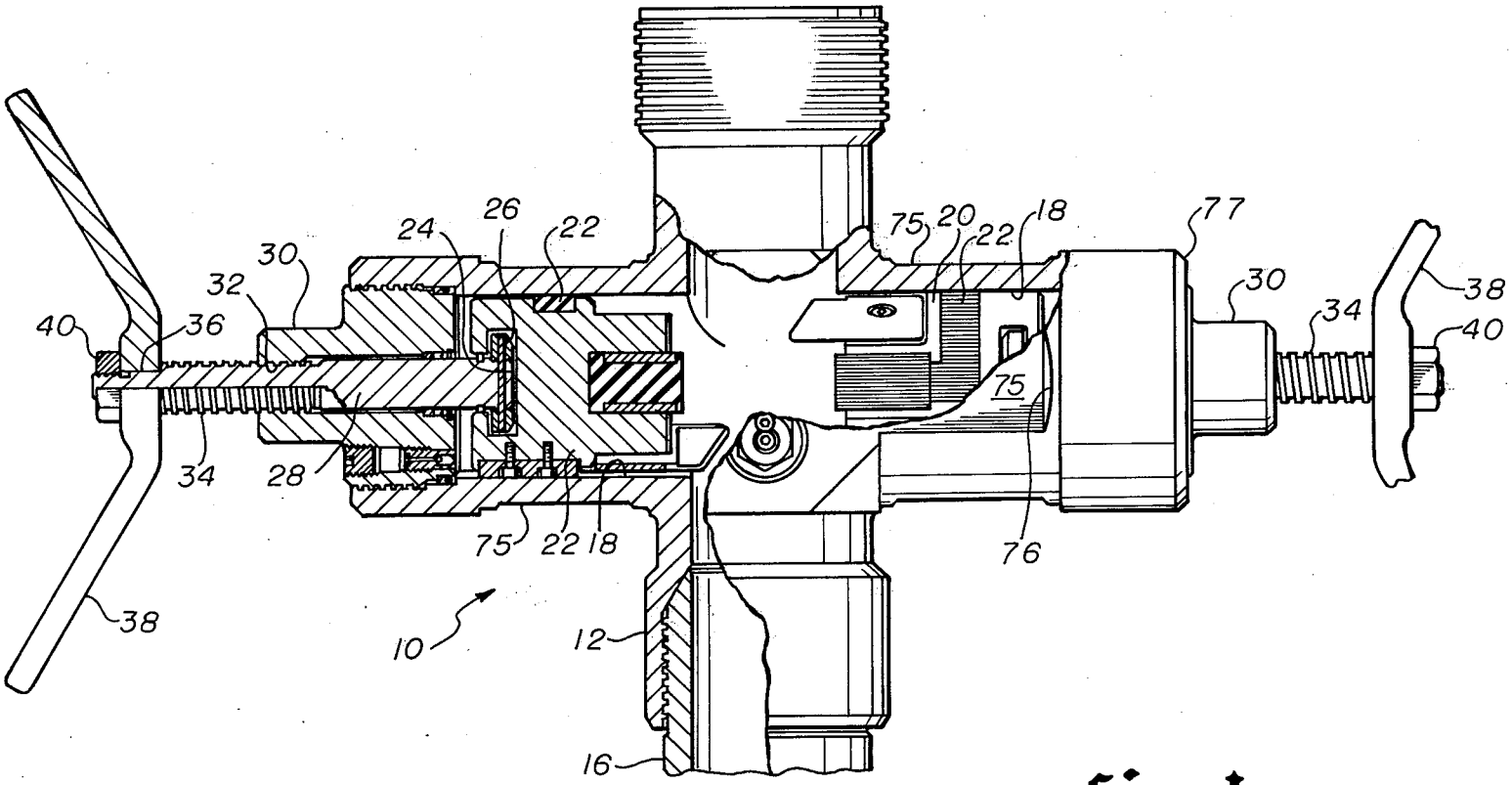
FIG. 1 is an elevation view of a manually operated blowout preventer on a wellhead with portions broken away to show the interior construction.

The manually operated blowout preventer 10 shown in FIG. 1 has a body 12 with the bore 14 extending vertically therethrough. The lower end of body 12 is threaded internally to connect to the wellhead 16 with the wellhead opening aligned with bore 14. Body 12 also has opposed guideways 18 which intersect bore 14. Rams 20 with suitable packing 22 are slidably mounted within the guideways 18 to open and close the bore 14. The back of each of rams 20 includes the slot 24 into which the stem nut 26 secured onto the end of stem 28 is received. End caps 30 are secured in the ends of body 12 surrounding the guideways 18 and have internal threads 32 which engage the threads 34 on stems 28. The outer ends of stems 28 include the flats 36 which are engaged by the handle 38. Handle 38 is secured in position by nuts 40. The upper exterior of body 12 is provided with suitable means such as threads 42 for connecting other equipment thereto.

Figure 2:
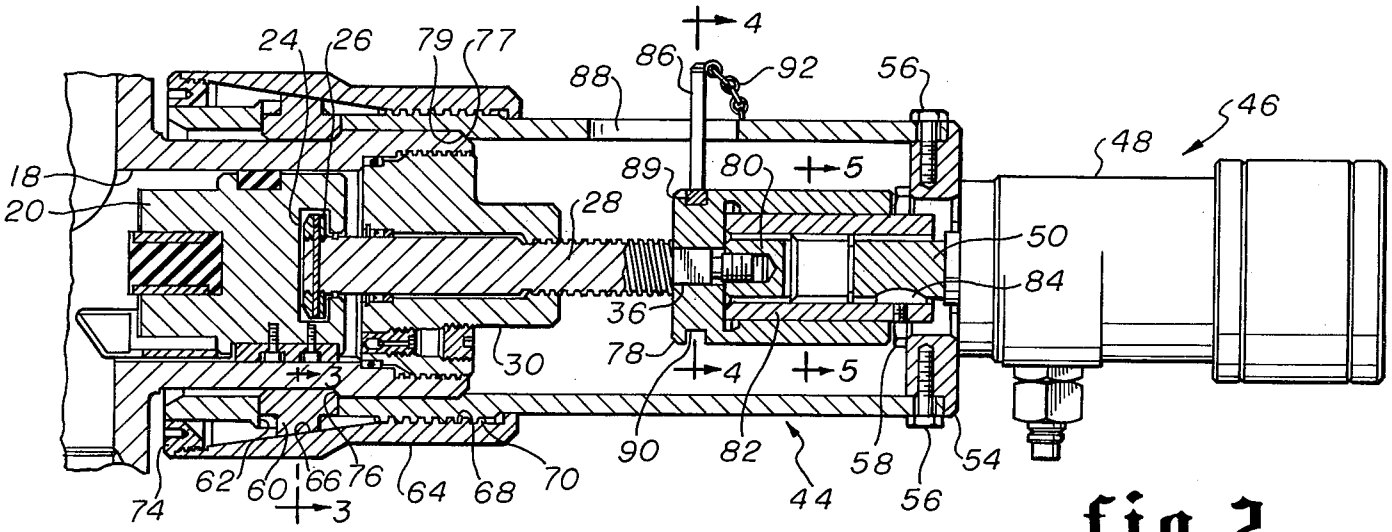
FIG. 2 is an elevation view, partly in section, showing the improved adapter apparatus of the present invention installed on one side of the blowout preventer of FIG. 1.
Figure 5:
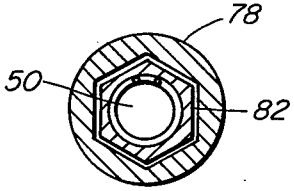
FIG. 5 is a sectional view taken along line 5—5 in FIG. 2.

Thus, rotation of handle 38 causes stem 28 to rotate and the threaded engagement of stem 28 in end cap 30 moves ram 20 depending on the direction of rotation either inwardly to its closed position or outwardly to its retracted open position which position is shown in FIGS. 1 and 2.

The manually operated blowout preventer 10 shown in FIG. 1 is illustrated in FIG. 2 with the improved adapter 44 mounted thereon. Adapter 44 provides a conversion to power operation for preventer 10. Such adapter 44 utilizes the handle flats 36 on stem 28 for driving stem 28 by motor 46.

The motor 46 is actuated by hydraulic fluid under pressure delivered thereto as hereinafter explained with reference to FIG. 6. The motor 46 includes the housing 48 and shaft 50 which rotates with respect to housing 48 when supplied with hydraulic fluid under pressure. Motor 46 is selected to rotate in either direction. A preferred motor is a Char-Lynn motor of the Char- Lynn S series, 23.0 cubic inch per revolution displacement hydraulic motor as manufactured by the Char-Lynn Plant, Fluid Power Division of Eaton Corporation, Eden Prairie, Minnesota. Other motors, such as electric motors and air motors, may be used provided they have adequate torque output for the actuation of the rams.

Figure 3:
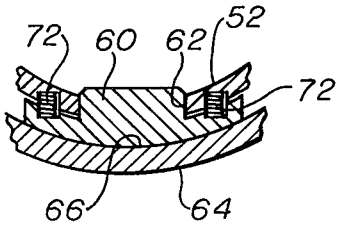
FIG. 3 is a sectional view taken along line 3—3 in FIG. 2.

The adapter 44 also includes the tubular housing or cylinder 52 which is secured to motor housing 48 by flange 54. Bolts 56 secure housing 52 to flange 54 and bolts 58 secure flange 54 to housing 48. A means is provided for quickly connecting and disconnecting housing 52 to body 12 surrounding the guideway 18. Such means includes the weld discs or latch dogs 60 positioned in windows 62 in housing 52, and the collar 64 having an internal cam surface 66 and interior threads 68 mating with the external threads 70 on housing 52. The latch dogs 60 are urged outwardly by the springs 72 which are engaged in recesses in dogs 60 and recesses in housing 52 as shown in FIG. 3. Retainer ring 74 is threaded into the end of collar 64 to retain it in position around housing 52 and latch dogs 60. The latch dogs 60, when urged inwardly, engage the shoulder 76 on the exterior portion of body 12 surrounding the outer portion of guideways 18.

Thus, as the collar is threaded inwardly (towards body 12) the dogs 60 are forced by the engagement of cam surface 66 with the outer portion of dogs 60 into fixed engagement with flats 75 and shoulder 76. Also, as the collar is threaded manually, the internal shoulder 79 in the cylinder 52 is brought into engagement with the chamber 79 formed on the outer end of housing 12. Thus, the cylinder 52 is held firmly in place and can neither move longitudinally nor rotate. While only one latch dog 60 is shown, it is contemplated that a plurality of them are to be used so that housing 52 is secured firmly to body 12.

Figure 4:
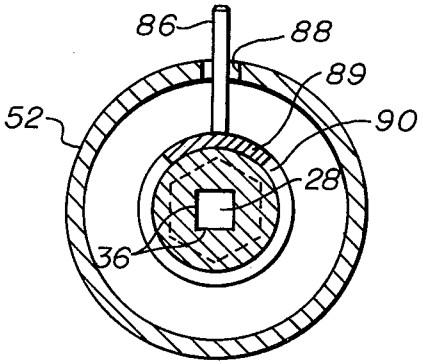
FIG. 4 is a sectional view taken along line 4—4 in FIG. 2.

Driving sleeve 78 is mounted on the outer end of stem 28 with retainer 80 securing it in position. As may be seen in FIG. 4, the interior of sleeve 78 includes the square shape for driving engagement with stem flats 36. The remainder of the interior of sleeve 78 is hex shaped and has drive coupling 82 positioned therein. Drive coupling 82 has an exterior hex shape that fits closely in driving engagement with the interior hex of driving sleeve 78. Woodruff key 84 provides a driving engagement between drive shaft 50 and drive coupling 82.

Thus, the power of motor 46 is transmitted by shaft 50 to coupling 82, to sleeve 78 and through the engagement of sleeve 78 on flats 36 to stem 28. As stem 28 is rotated, ram 20 moves responsive thereto.

The indicator pin 86 extends through the slot 88 in housing 52 and has a saddle 89 on its inner end engaged within the exterior groove 90 in driving sleeve 78. The chain 92 is secured to the outer end of indicator pin 86 and to the exterior of housing 52 to prevent loss of pin 86.

Figure 6:
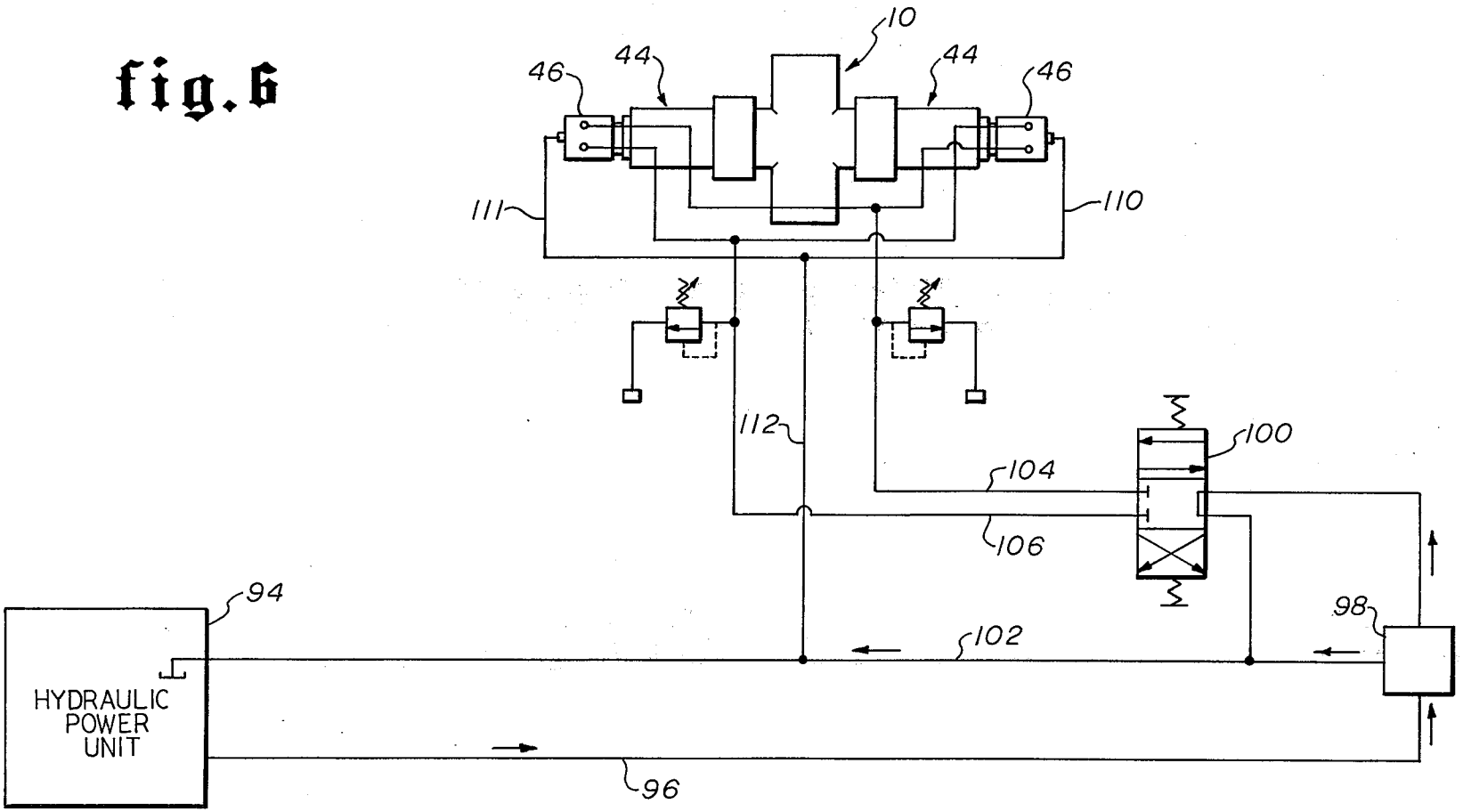
FIG. 6 is a diagram of the hydraulic system for hydraulic operation of the improved blowout preventer.

The control of motors 46 is provided by the system shown schematically in FIG. 6. A suitable source 94 of hydraulic fluid under pressure, such as a truck or boat, is connected through line 96 to flow controller 98. Hydraulic fluid under control is delivered to the four-way control valve 100 from controller 98 and excess fluid is returned through exhaust line 102. In one position of valve 100 the hydraulic fluid is returned to exhaust line 102. In a second position the hydraulic fluid is delivered through line 104 to actuate motors 46 to close rams 20 and the exhaust of motors 46 is returned through line 106 and valve 100 to exhaust line 102. Reverse rotation of motors 46 is provided by delivering hydraulic fluid through valve 100 to line 106 and exhausting motors 46 through line 104. Drain lines 110, 111 and 112 are provided as shown to drain leakage from the motors 46 to the tank 94.

Figure 7:
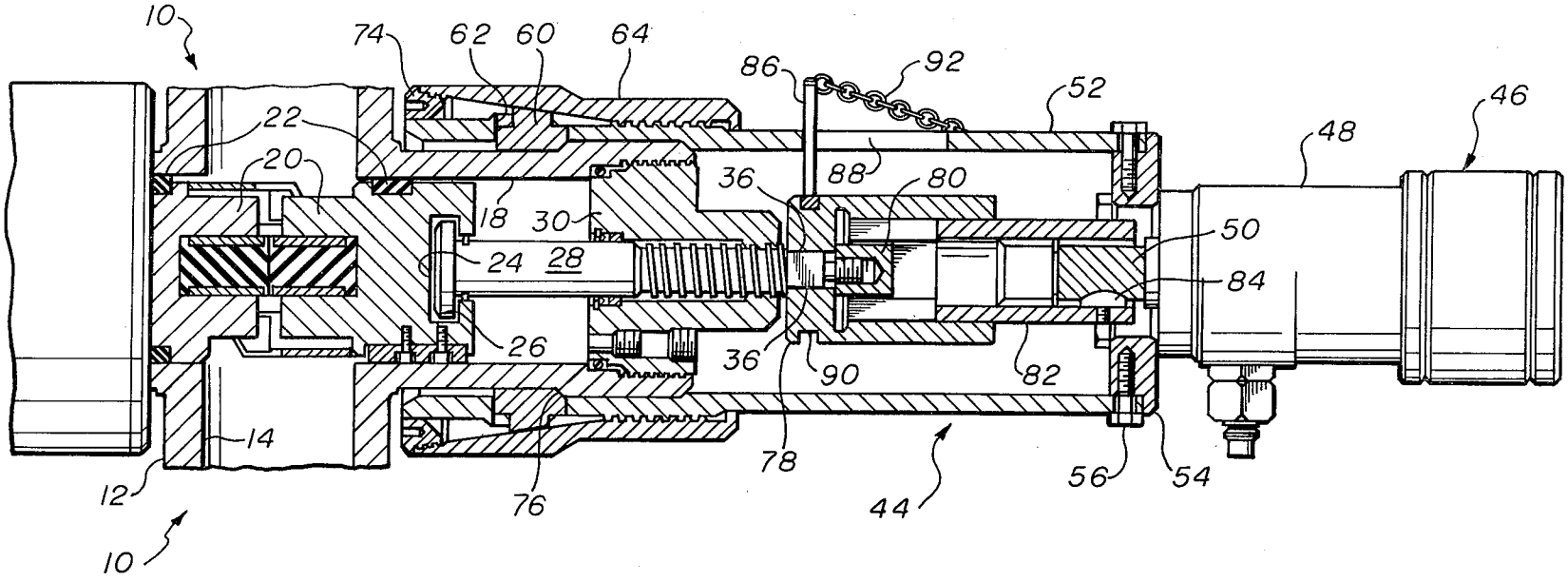
FIG. 7 is a view similar to FIG. 2 showing the ram moved to closed position.

FIG. 7 illustrates the rams 20 moved by hydraulic motors 46 to the closed position from the open position shown in FIG. 2.

The installation of adapters 44 is simply and quickly accomplished by removing nuts 40 and handles 38 from stems 28. Driving sleeve 78 is mounted on stem 28 and retainer 80 threaded thereon to hold driving sleeve 78 in position. Drive coupling 82 which is secured to shaft 50 is then inserted into sleeve 78 as tubular housing 52 is pushed over the body extension around guideway 18. Collar 64 is threaded inward on housing 52 so that cam surface 66 forces latch dogs 60 into engagement with the shoulder 76. In this position the hydraulic lines can then be connected to motor 46 and then the rams 20 are power operated.

This conversion is done easily with the usual tools available at wellhead sites. One particular advantage of this structure is that the adapter uses the stem flats 36 for its power drive so the stem 28 and end cap 30 remain in place during conversions. This allows the rams 20 to be held in any desired position (open or closed) during conversion so that the preventer 10 does not have to be isolated from wellhead pressure for the conversion.

What is claimed is:

1. A blowout preventer comprising a body having a bore therethrough and guideways intersecting said bore from opposite sides thereof, a ram positioned in each of said guideways, means closing the outer end of each of said guideways, an operating stem having flats on its outer end, being connected to each of said rams at its inner end and threadedly engaging with and extending through said closing means whereby rotation of said stem in one direction moves the stem and its ram toward closed position in said bore and rotation of said stem in the opposite direction retracts the stem and said ram in its guideway away from its closed position, a hydraulic motor having a shaft and a housing, means for operatively connecting the shaft of said motor to said operating stem for rotating said stem as it moves axially, means for quickly connecting said housing of said motor to said body while said blowout preventer is under pressure, and means for supplying hydraulic fluid to said motor to selectively rotate said shaft and said stem in both directions, said means for connecting said housing of said motor to said body including a plurality of latch dogs, a plurality of recesses in the exterior of said body surrounding the exterior of each of said guideways, a cylinder having windows in which said latch dogs are positioned, resilient means positioned between said latch dogs and said cylinder urging said latch dogs away from said recesses, and means for securing one end of said cylinder to the motor housing, a sleeve threadedly connecting to said cylinder, said sleeve having an inner cam surface engaging the exterior of said latch dogs whereby as said sleeve is moved in one direction on said cylinder, it moves said latch dogs into said recesses to connect the motor housing to said body.

2. A blowout preventer according to claim 1 wherein said shaft-stem connecting means includes a driving sleeve connected to said shaft and engaging the flats of said stem.

3. A blowout preventer according to claim 1 including means providing an indication of the position of each of said rams.

4. A blowout preventer according to claim 3 wherein said indicating means includes a slot in each of said housings, a pin extending through each of said slots and engaging the driving sleeves whereby said pin moves with the inward and outward movement of said stem.

5. A blowout preventer comprising a body having a bore therethrough and guideways intersecting said bore from opposite sides thereof, a ram positioned in each of said guideways, means closing the outer end of each of said guideways, an operating stem having flats on its outer end, being connected to each of said rams at its inner end and threadedly engaging with and extending through said closing means whereby rotation of said stem in one direction moves the stem and its ram toward closed position in said bore and rotation of said stem in the opposite direction retracts the stem and said ram in its guideway away from its closed position, a motor having a shaft and a housing, means for operatively connecting the shaft of said motor to said operating stem for rotating said stem as it moves axially, means for quickly connecting said housing of said motor to said body while said blowout preventer is under pressure, and means for supplying power to said motor to selectively rotate said shaft and said stem in both directions, said means for connecting said housing of said motor to said body including a plurality of latch dogs, a plurality of recesses in the exterior of said body surrounding the exterior of each of said guideways, a cylinder having windows in which said latch dogs are positioned, a resilient means positioned between said latch dogs and said cylinder urging said latch dogs away from said recesses, and means for securing one end of said cylinder to the motor housing, a sleeve threadedly connecting to said cylinder, said sleeve having an inner cam surface engaging the exterior of said latch dogs whereby as said sleeve is moved in one direction on said cylinder, it moves said latch dogs into said recesses to connect the motor housing to said body.

* * * * *